US005655420A

United States Patent [19]

Ogawa et al.

[11] Patent Number: 5,655,420

[45] Date of Patent: Aug. 12, 1997

[54] MAGNETIC TIGHTENING TOOL FOR PREVENTING OVERTIGHTENING AND UNDERTIGHTENING

[75] Inventors: Shuhei Ogawa; Tetsuya Kojima; Hiroshi Ogawa; Koichiro Shoda, all of Osaka, Japan

[73] Assignee: Fujikin Incorporated, Osaka, Japan

[21] Appl. No.: 531,448

[22] Filed: Sep. 21, 1995

[30] Foreign Application Priority Data

Sep. 26, 1994 [JP] Japan ..... 6-229641

[51] Int. Cl.[6] ..... B25B 23/142

[52] U.S. Cl. ..... 81/467; 81/478

[58] Field of Search ..... 81/467, 473, 472, 81/478, 480, 481, 900, 53.2, 54.1, 56.1; 192/56.4

[56] References Cited

U.S. PATENT DOCUMENTS 3,783,716 1/1974 Saito ..... 81/473

5,236,053 8/1993 Butsch ..... 81/467

*Primary Examiner*—James G. Smith

*Assistant Examiner*—Joni B. Danganan

*Attorney, Agent, or Firm*—Armstrong, Westerman, Hattori, McLeland & Naughton

[57] ABSTRACT

A tightening tool comprises a head having a socket for a nut to fit in, a head support supporting the head rotatably about the axis of the socket, and a handle integral with the head support. A magnet is attached to each of the head and the head support. The head and the head support are joined together by a force of attraction permitting these portions to rotate relative to each other upon the torque of tightening up the nut reaching a proper value. When the head support is rotated by turning the handle by hand, the head moves with the head support to tighten the nut. After the nut tightening torque has reached the proper value, the head support merely rotates idly with the head and the nut remaining unrotated even if the handle is turned.

4 Claims, 4 Drawing Sheets

MAGNETIC TIGHTENING TOOL FOR PREVENTING OVERTIGHTENING AND UNDERTIGHTENING

BACKGROUND OF THE INVENTION

The present invention relates to tightening tools for use in cases involving the problem of over-tightening or under-tightening as in tightening up pipe joints.

The production equipment of the chemical industry and semiconductor industry includes piping systems for transporting or controlling fluids and maintaining or controlling a vacuum. Joints are generally used for connecting pipes together and for connecting a pipe to a valve, flow meter or like instrument, or reactor. High gastightness, corrosion resistance to fluid substance and a superhigh degree of cleanliness with the utmost freedom from dust are required of the piping system especially in the semiconductor industry. For example, FIG. 8 shows a joint which is used as the most suitable one from this viewpoint.

With reference to the drawing, a first joint member 21 and a second joint member 22 are butted against each other with an annular gasket 23 interposed therebetween, and the first joint member 21 is fastened to the second joint member 22 with a nut 24 provided on the second member 22 and screwed on the first member 21. A pipe 25 is inserted in the second joint member 22 from the other end thereof and fixed to the second member 22 at a welded portion 26. Gasket holding annular ridges 27, 28 are formed on the butting ends of the first and second joint members 21, 22, respectively, The gasket 23 is held to the end of the first joint member 21 by a retainer 29.

With the pipe joint described, it is not desirable that the nut tightening torque be too small or too great. If the torgue is too small, gastightness is not available, while too great a torque will excessively deform or break the gasket 23 to result in creation of dust or lower corrosion resistance, consequently leading to impaired gastightness. Thus, it is important that the nut 24 be tightened up with an appropriate torque. This is also true of the case wherein a metal ring, such as an O-ring or ferrule, is provided between the butting ends of the first and second joint members 21, 22 in place of the gasket A spanner is usually used for tightening up such a joint. The joint is tightened up suitably by manually tightening up the nut 24 on the first joint member 21, making a mark on each of the member 21 and the nut 24 in this state and thereafter rotating the nut with the spanner through a required angle (e,g., ¼ of a turn) with reference to the marks.

The use of the spanner as a tightening tool thus necessitates the procedure of making a mark on each of the first joint member and the nut as tightened up thereon by hand and thereafter rotating the nut with the spanner through the required angle while visually recognizing the marks. However, this procedure needs labor, depends largely on intuition and has the problem of low reliability, for example, because the manual tightening force differs from person to person or varies according to the mood of the moment, A device therefore appears useful which is adapted to tighten up the nut white detecting the tightening torque and determining whether the detected torque is proper, but such a device will be a great one and inferior to the conventional tool in respect of the manufacturing cost and easiness of use.

SUMMARY OF THE INVENTION

An object of the present invention is to provide a tightening tool which is adapted to tighten up pipe joints or the like reliably without necessitating much labor and which is nevertheless inexpensive and easy to use.

The present invention provides a tightening tool comprising a head having a socket for an engagement portion of a threaded member to fit in, a head support supporting the head rotatably about the axis of the socket, and a handle integral with the head support, a magnet being attached to one of the head and the head support, an attracted portion being provided in the other and attractable to the magnet, the head and the head support being joined together by a force of attraction so as to be rotatable relative to each other upon the torque of tightening up the threaded member reaching a proper value.

When the head support of the tightening tool of the invention is rotated by turning the handle with a nut fitted in the socket of the head, the head and the head support, which are joined together by the force of attraction of the magnet, move together to tighten the nut with an increasing torque. Upon the tightening torque reaching a proper value, the head support merely rotates idly with the head remaining unrotated even if the handle is further turned, whereby the nut can be tightened up with the proper torque. When pipe joints or the like are to be tightened up, it is conventionally necessary to make a mark on each of the first Joint member and the nut as tightened up thereon by hand and thereafter rotate the nut with a spanner through the required angle while visually recognizing the marks, whereas the present invention eliminates tile need for this procedure, making it possible to tighten up the pipe joint or the like reliably without much labor. The invention further obviates the need for the procedure of determining whether the tightening torque is proper while detecting the torque. The present tool is therefore easy to use and inexpensive to manufacture.

Preferably, the position of the magnet is made adjustable. The force of attraction is then adjustable by moving the magnet and thereby varying the distance between the magnet and the attracted portion. This makes it possible to tighten up different threaded members each with a torque proper thereto.

According to an embodiment, the head support is a nonmagnetic member, and a ferromagnetic member is movably disposed in the magnetic circuit comprising the magnet and the magnetically attractable member. The ferromagnetic member inserted in the magnetic circuit increases the force of attraction of the magnet, and this force is adjustable by moving the ferromagnetic member within the magnetic circuit, so that the threaded member can be tightened up with a greater torque. It is also possible to tighten up different threaded members each with a torque proper thereto.

According to another embodiment, the head support is a ferromagnetic member, and a nonmagnetic member is movably disposed in the magnetic circuit comprising the magnet and the attracted portion. The head support, which is ferromagnetic, then adds to the force of attraction of the magnet, and the force of attraction is adjustable by moving the nonmagnetic member within the magnetic circuit. This makes it possible to tighten up the threaded member with an increased torque and further to tighten up different threaded members each with a torque proper thereto.

BRIEF DESCRIPTION OF THE INVENTION

Figure 3A:
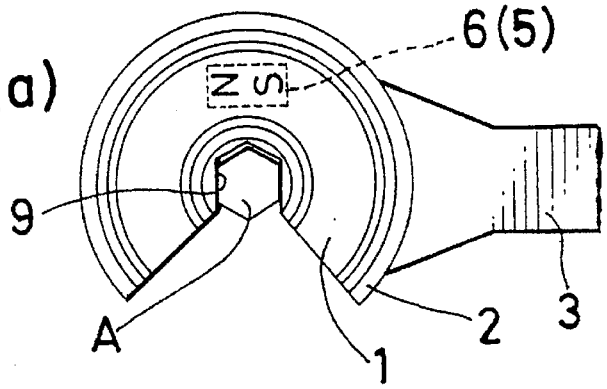
Figure 3B:
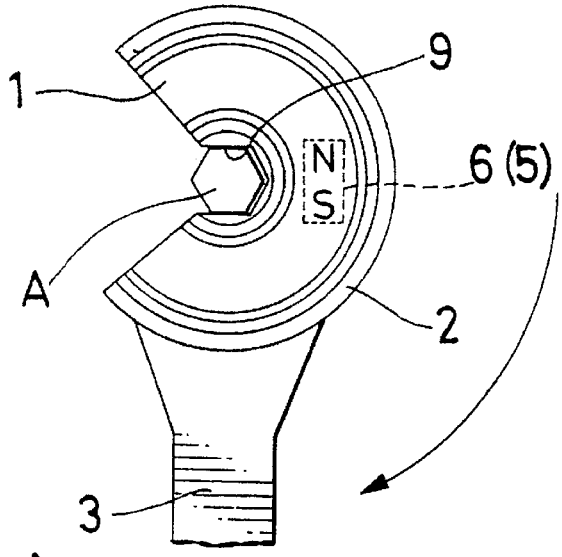
Figure 3C:
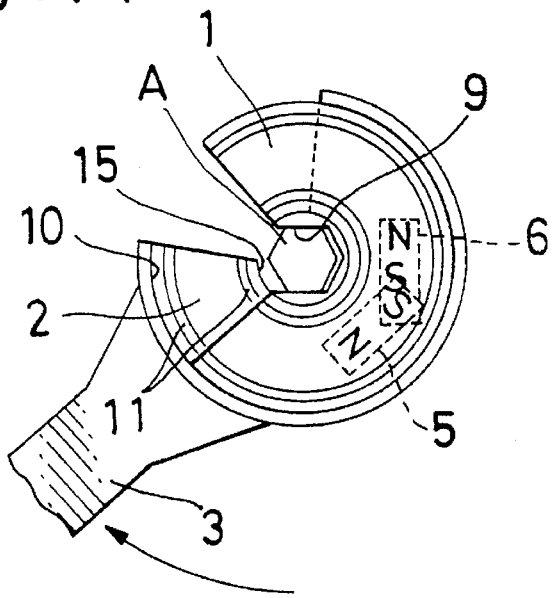
Figure 4:
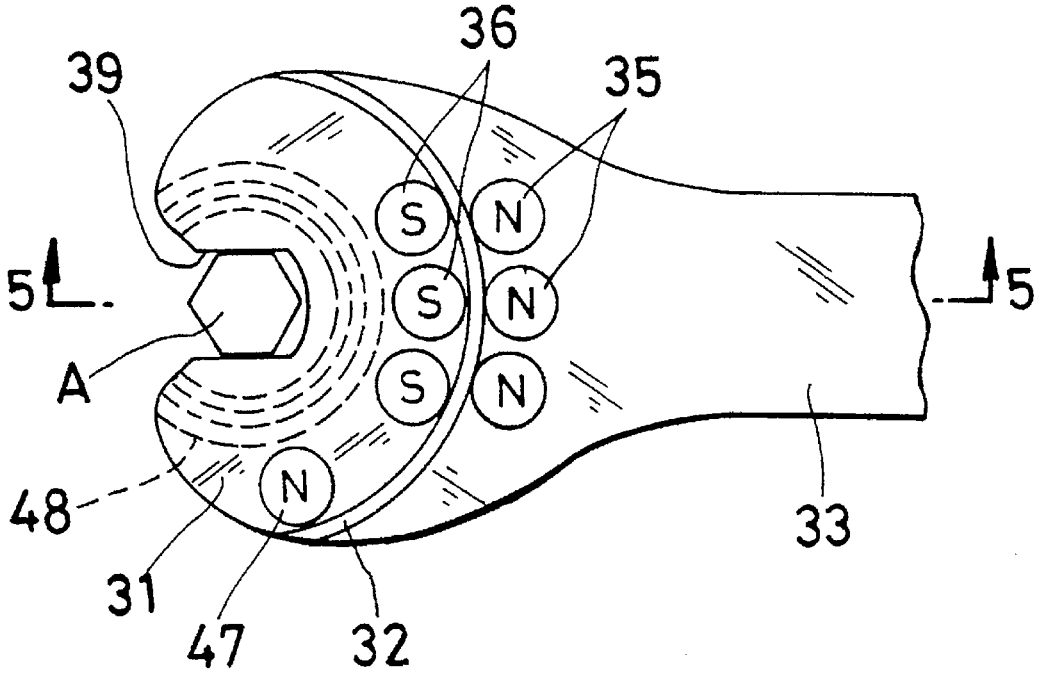
Figure 5:
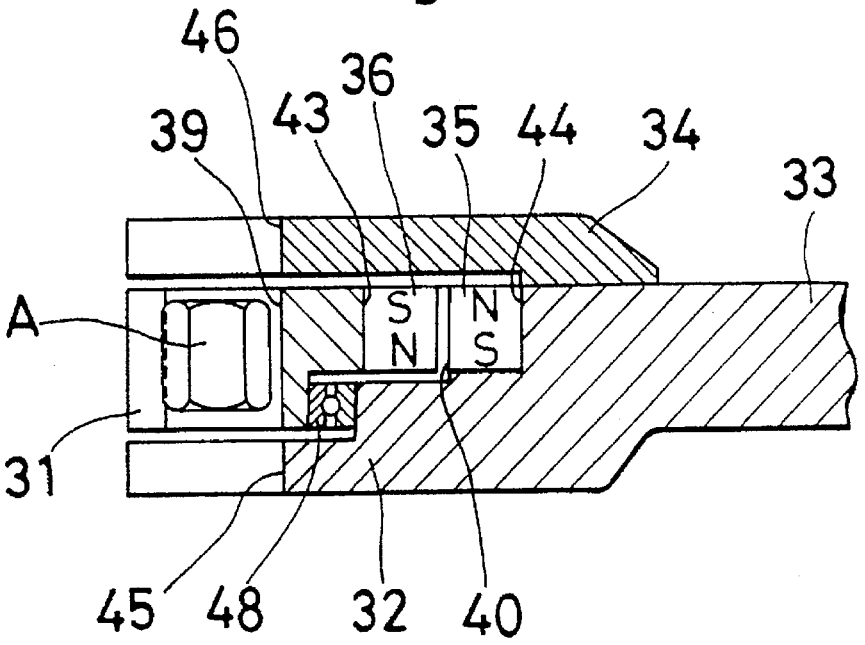
Figure 6:
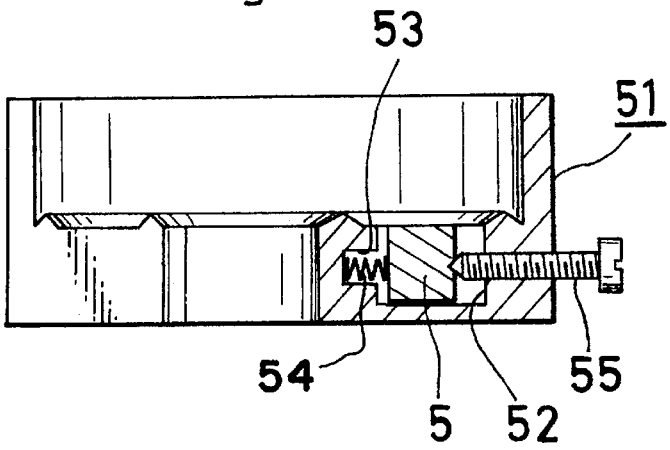
Figure 7:
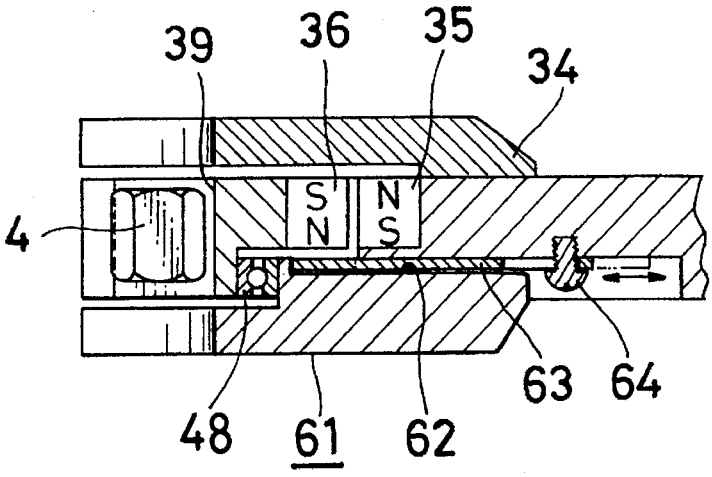

FIGS. 3(*a*) to 3(*c*) are plan views showing the tightening tool of the invention in use for tightening up a nut, (a)

showing the tool at the start of tightening, (b) showing the tool immediately before completion of tightening and (c) showing the tool on completion of tightening;

FIG. 4 is a plan view showing a second embodiment of tightening tool of the invention;

FIG. 5 is a view in section taken along the line 5—5 in FIG. 4;

FIG. 6 is a sectional view showing an example of arrangement for producing a variable force of attraction in the tightening tool of the invention;

FIG. 7 is a sectional view showing another example of like arrangement; and

Figure 8:
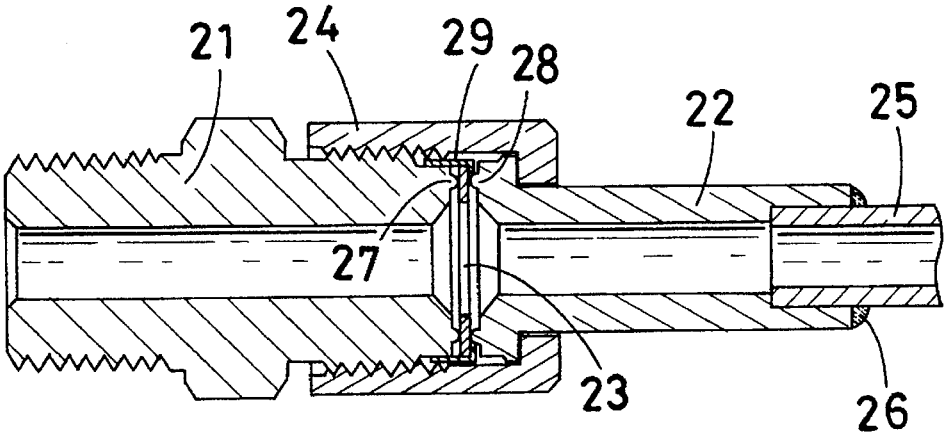
Fig.8 PRIOR ART

FIG. 8 is a view in longitudinal section showing an example of joint for use with the tightening tool of the invention.

DESCRIPTION OF THE PREFERRED EMBODIMENTS

Embodiments of the invention will be described below with reference to the drawings. In the following description, the terms "upper" and "lower" are used based on FIG. 2; the upper and lower sides of FIG. 2 will be referred to by "upper" and "lower," respectively. These terms are relative, and the tool may be used with its upper side positioned down, laterally or obliquely.

Figure 1:
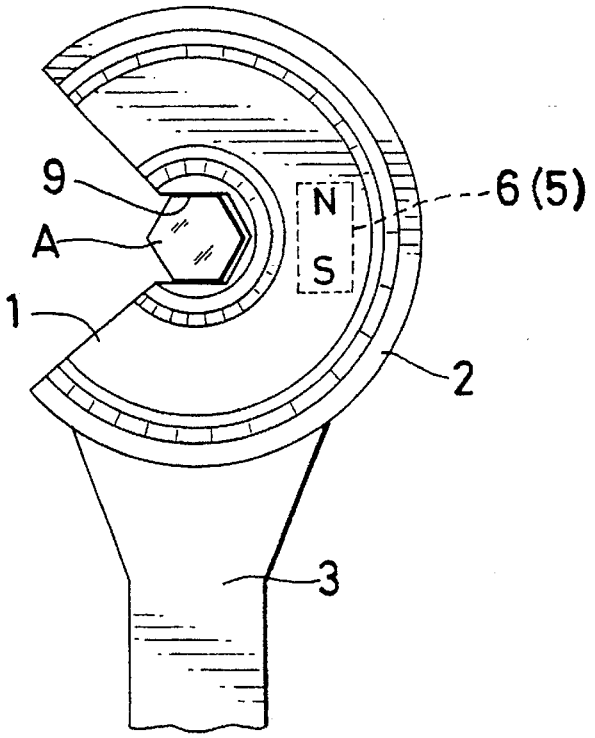
FIG. 1 is a plan view showing a first embodiment of tightening tool according to the invention.
Figure 2:
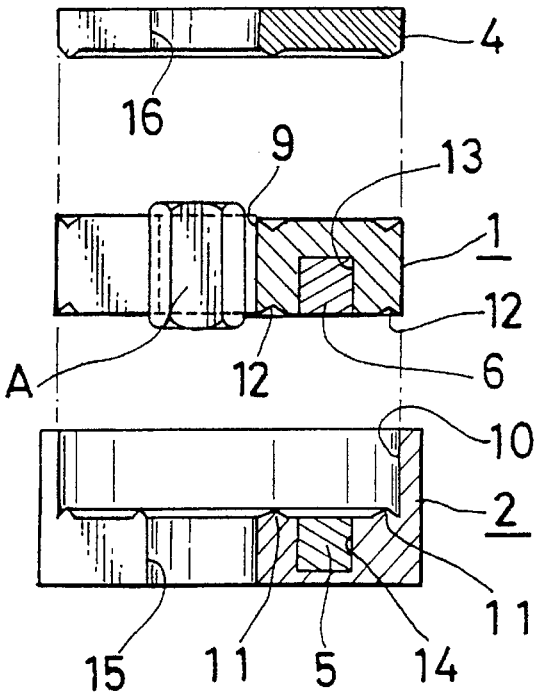
FIG. 2 is an exploded sectional view of the same.

FIGS. 1 to 3 show a first embodiment of tightening tool. The tightening tool comprises a platelike head 1 having a socket 9 which is open at one side for an engagement portion of a threaded member (such as the head of a bolt or nut or a flange of a pipe joint) to fit in, a head support 2 supporting the head 1 rotatably about the axis of the socket 9, a handle 3 integral with the head support 2, and a cover 4 provided over the head 1. For the convenience of description, FIGS. 1 and 3 show the tool with the cover 4 removed.

The head 1, head support 2 and handle 3 are each made of stainless

The width of opening of the socket 9 is in conformity with the size of the engagement portion of the threaded member to be tightened up, for example, with the external size of the nut, size of the bolt head or size of the flange of the joint member.

The head support 2 is slightly larger than the head in section. The head support 2 is formed with a recess 10 for the head 1 to fit in.

The bottom surface of the head 1 is formed with two circular-arc grooves 12 centered about the axis of the socket 9. Circular-arc guide ridges 11 fittable in the respective grooves 12 are provided on the bottom surface of the recessed portion 10.

A rectangular cavity 14 is formed in the head support 2 from above. A permanent magnet 5 is fitted in the cavity 14 and bonded to the support 2 with an epoxy adhesive. A rectangular cavity 13 positioned as opposed to the cavity 14 of the head support 2 is formed in the head 1 from below. An magnetically attractable member 6 is fitted in the cavity 13 and bonded to the head 1 with the epoxy adhesive.

The permanent magnet 5 is in the form of bar and fitted in horizontally. The magnetically attractable member 6 is a bar magnet like the magnet 5 and fitted in in opposite relation with the magnet 5 in polarity. Consequently, the head 1 is joined to the head support 2 by a force of attraction between the magnet 5 and the magnetically attractable member 6, Openings 15, 16 coaxial with the socket 9 are formed in the held support 2 and the cover 4, respectively, and are so sized as to avoid interference with the threaded member to be fitted into the socket 9.

For example, in the case where a nut A on a joint (not shown) is to be tightened, the head support 2 is turned by holding the handle 3 with the nut A fitted in the socket 9 of the head 1 as seen in FIG. 3(*a*). Since the head 1 and the head support 2 are joined together by the force of attraction of the magnets 5, 6, the torque applied to the handle 3 is transmitted as it is to the head 1, moving the head support 2 and the head 1 together to tighten the nut A (see FIG. 3(*b*)). Although the magnet of magnetically attractable member 6 is illustrated as superposed on the magnet 5, these magnets are opposite in porality. Stated more specifically, the N and S poles of the magnet of magnetically attractable member 6 are positioned as illustrated, but the N and S poles of the underlying magnet 5 are positioned in opposite relation with the N and S poles of the magnet of magnetically attractable member 6 (although not shown). With the rotation of the nut A, the tightening torque increases and becomes equal to the torgue due to the force of attraction between the magnet 5 and the magnetically attractable member 6. The head support 2 thereafter merely rotates idly with the head 1 and the nut A remaining unrotated even if the handle 3 is turned (see FIG. 3(*c*)). Because the force of attraction between the magnet 5 and the magnetically attractable member 6 still remains although small, the head 1 will not separate from the head support 2, while a change in the reaction delivered to the hand of the worker indicates completion of tightening.

Accordingly, the characteristics values of the magnet 5 and the magnetically attractable member 6 are so determined as to give a force of attraction which permits the head support 2 to rotate relative to the head 1 upon the tightening torque reaching a proper value, whereby the threaded member can be tightened up completely without further tightening when the proper torque is reached. Incidentally, the optimum torque value for tightening up joints is, for example, about 100 kgf·cm for pipes having an inside diameter of ⅜ inch although variable with the type of pipes.

FIGS. 4 and 5 show a second embodiment of tightening tool according to the invention.

The tightening tool comprises a platelike head 31 having a socket 39 which is open at one side for an engagement portion of a threaded mender to fit in, a head support 32 supporting the head 31 rotatably about the axis of the socket 39, a handle 33 integral with the head support 32, and a cover 34 provided over the head 31. For the convenience of description, FIG. 4 shows the tool with the cover 34 removed.

The head 31, head support 32 and handle 33 are all made of stainless steel.

The head support 32 is slightly larger than the head 31 in section. The head support 32 is formed with a recess 40 for the head 31 to fit in. A ball bearing 48 is provided between the head 31 and the recessed portion 40.

Three cavities 44 close to one another are formed in the head support 32 from above along the inner periphery of the recess 40. A permanent magnet 35 is fitted in each of the cavities 44 and bonded to the support 32 with an epoxy adhesive. Three cavities 43 positioned as opposed to the respective cavities 44 are formed in the head 31 from above. An magnetically attracted member 36 is fitted in each of the cavities 43 and bonded to the head 3i with the epoxy adhesive.

The permanent magnet 35 is in the form of a bar and fitted in vertically. The attraction member 36 is the same bar magnet as the magnet 35 and fitted in in opposite relation with the magnet 35 in polarity. Consequently, the head 31 is joined to the head support 32 by a force of attraction between the magnets 35 and the magnetically attractable members 36.

The head 31 is further provided with a restoring permanent magnet 47. This permanent magnet 47 is positioned in the same relation with the permanent magnets 36 of the head support 32 in polarity. When the head support 32 is rotated idly with the tightening torque exceeding the proper value, the magnet 47 gives the head support 32 a force acting in a direction to return the support 32 toward the position where the head 31 is joined to the support 32 with the force of attraction between the magnets 35 and the magnetically attractable members 36.

Openings 45, 46 coaxial with the socket 39 are formed in the head support 32 and the cover 34, respectively, and are so sized as to avoid interference with the threaded member to be fitted into the socket 39.

The function and movement of the components of the tool of the second embodiment for tightening up a joint are nearly the same as those described for the first embodiment with reference to FIGS, 3(*a*) to (*c*). However, when the head support 32 of the second embodiment has rotated idly after the completion of tightening, the presence of the restoring permanent magnet 47 makes it easy for the head support to return to the position before the idle rotation.

According to the two embodiments described, examples of suitable magnets 5, 35 are powerful ones including rare earth element magnets such as anisotropic sintered magnets consisting essentially of neodymium, iron and boron. Examples of useful epoxy adhesives for fixing these magnets 5, 35 and magnetically attractable members 6, 36 are Araldite 138 and Araldite 150. Instead of using the adhesive, the magnets 5, 35 and magnetically attractable members 6, 36 may be fixed by soldering or silver brazing. Preferably, the magnets are smaller in size. To incease the force of attraction of the magnet, the magnetic flux emanating from the magnet is prevented from spreading out to the greatest possible extent. The magment exhibits a reduced force when so shaped that the N pole and S pole thereof are too close to each other. A greater force of attraction is available by uaing bar magnets as the magnetically attractable members 6, 36 and arranging two bar magnets with the different poles opposed to each other. However, the magnetically attractable members 6, 36 may be ferromagnetic members instead of magnets. An electromagnet may be used in place of the magnet to obtain a magnetic force. Although the heads 1, 31 and the head supports 2, 32 are made of stainless steel, other material, e.g., ferromagnetic iron, may used. When the heads 1, 31 and head supports 2, 32 are prepared from stainless steel, a ferromagnetic material such as iron, nickel, cobalt or an alloy thereof may be bonded to a magnet to make a yoke to prevent the magnetic flux from spreading out and form a magnetic circuit.

According to the present invention, the proper value of torque to be applied to the nut of the joint, i.e., the maximum torque value of the tightening tool, is adjustable by altering the relative position of magnets attracting each other, or by strengthening the magnetic circuit comprising these magnets.

FIG. 6 shows an example wherein the force of attraction of a magnet is variable by altering the position of the magnet, i.e., a modification of the head support 2 shown in FIG. 2. The modified head support 51 has a rectangular cavity 52 for the magnet 5 to fit in. To render the magnet 5 movable in the cavity 52 radially of the support 51, the cavity 52 is made larger than the magnet 5 and provided with a spring retaining recess 53 extending radially inward. A coiled compression spring 54 is fitted in the recess 53, and a screw 55 for holding the magnet 5 against the force of the spring is radially driven into the rectangular cavity 52 from outside. When advanced or retracted, the screw 55 varies the distance of the magnet 5 from the attraction member 6 to vary the force of attraction.

FIG. 7 shows an example wherein a magnetic circuit comprising a magnet is strengthened or weakened to give a variable force of attraction, i.e., a modification of the embodiment shown in FIG. 4. A head support 61 made of stainless steel is formed with a slit 62 extending radially thereof and has an iron plate 63 movably inserted in the slit 62 and a setscrew 64 for locking the plate 63 in position. When the iron plate 63 is radially moved to the inner-most position, the inner end of the plate is positioned immediately below the magnet 35 and attraction member 36, while when the plate 63 is radially moved to the outermost position, the plate end is brought out of the position immediately below the magnet 35 and the magnetically attractable member 36. The greatest force of attraction is available when the inner end of the iron plate 63 is brought to the position immediately below the magnet 35 and the attraction member 36, and the force decreases as the plate inner end moves away from the position. Thus, the force of attraction is adjustable by moving the nonmagnetic plate. The plate 63 may of course be made of a ferromagnetic material other than iron.

The same arrangement as shown in FIG. 7 may be provided by using iron or like ferromagnetic material for the head support 61 and aluminum, stainless steel or like nonmagnetic material for the plate 63. The head support 61, which is ferromagnetic in this case, increases the force of attraction between the magnet 35 and the magnetically attractable member 36, while the plate of nonmagnetic material acts to reduce the force of attraction. The force of attraction can be adjusted by moving the nonmagnetic plate.

Although the tightening tools embodying the present invention described are suitable for tightening up pipe joints reliably without necessitating much labor, the members to be tightened up by these tools are not limited to pipe joints but include bolts and nuts which are widely used at present in motor vehicles, rolling stock, aircraft and like transport machines, buildings, bridges and like structures, or electric apparatus, precision devices, machine tools, etc. Needless to say, tightening up bolts or nuts with a proper torque is of extreme importance in these fields in ensuring reliability and safety.

What is claimed is:

1. A tightening tool, comprising:

a head having socket for an engagement portion of a threaded member to fit in;

a head support supporting said head rotatably about the axis of the socket;

a handle integral with said head support;

a magnet being attached to one of said head and said head support; and a magnetically attractable member being provided in the other of said head and said head support and attractable to said magnet, wherein said head and said head support are joined together by a force of attraction so as to be rotatable relative to each other upon the torque of tightening up said threaded member reaching a proper value.

2. A tightening tool as defined in claim 1, wherein the position of said magnet is adjustable.

3. A tightening tool as defined in claim 1, wherein said head support made of a nonmagnetic member, is provided with a radially extending slit, and a ferromagnetic member is movably disposed in said slit.

4. A tightening tool as defined in claim 1, wherein said head support, made of a ferromagnetic member, is provided with a radially extending slit, and a nonmagnetic member is movably disposed in said slit.

* * * * *